United States Patent [19]

Scarpa et al.

[11] 4,429,864

[45] Feb. 7, 1984

[54] HIGH SPEED CARTON FEEDER

[75] Inventors: Eric W. Scarpa, Cincinnati, Ohio; Charles C. Hughes, Villa Hills, Ky.; Stanley F. Humbert, Cincinnati, Ohio

[73] Assignee: R. A. Jones & Co. Inc., Covington, Ky.

[21] Appl. No.: 276,081

[22] Filed: Jun. 22, 1981

[51] Int. Cl.[3] ..... B65H 3/28; B65H 5/22

[52] U.S. Cl. ..... 271/10; 221/225; 271/97; 271/30 A; 271/113; 271/195; 414/330; 493/313

[58] Field of Search ..... 271/113, 101, 97, 105, 271/30 A, 150, 149, 166, 126, 23, 22, 129, 8 A, 10, 16, 17, 12, 11, 271, 31, 98, 195, 276, 24, 25, 107, 100; 414/330, 116, 126, 129; 493/313, 314, 318; 221/224, 225

[56] References Cited

U.S. PATENT DOCUMENTS

| | | | |
|---|---|---|---|
| 769,927 | 9/1904 | Zeh | 271/8 A |
| 1,244,086 | 10/1917 | Harvey | 271/113 |
| 2,797,092 | 6/1957 | Welsh | 271/113 X |
| 2,817,517 | 12/1957 | Wittkuhns et al. | 271/23 |
| 2,826,411 | 3/1958 | Monroe et al. | 271/150 |
| 3,125,229 | 3/1964 | Mulquin et al. | 271/113 X |
| 3,385,594 | 5/1968 | Preisig | 271/101 X |
| 3,429,570 | 2/1969 | Scully | 271/12 |
| 3,717,337 | 2/1973 | McCain et al. | 271/100 X |
| 3,761,072 | 9/1973 | Deering et al. | 271/12 |
| 3,894,732 | 7/1975 | Müller | 271/10 |

FOREIGN PATENT DOCUMENTS

| | | | |
|---|---|---|---|
| 806139 | 6/1951 | Fed. Rep. of Germany | 271/98 |
| 446403 | 3/1968 | Switzerland | 271/113 |

*Primary Examiner*—Bruce H. Stoner, Jr.
*Attorney, Agent, or Firm*—Wood, Herron & Evans

[57] ABSTRACT

A high speed feeder for cartons being fed into a cartoner includes both mechanical and fluid flow environments for precisely delivering cartons. A preferably inclined conveyor receives cartons stacked on their edges and in a generally vertical orientation. A rotating metering wheel at the downstream end of the conveyor engages the top edges of the cartons and separates them one at a time from the incoming stack. A blower is provided to direct air onto the cartons adjacent the metering wheel to (a) blow the cartons against the metering wheel, (b) blow air between the first and second cartons of the stack as the metering wheel separates the first from the second, and (c) blow the cartons down to a horizontal attitude. Horizontal feed chains having feed lugs receive the horizontal cartons and advance them one at a time into the cartoner. Vacuum nozzles are provided to aid in controlling carton placement on the feed chains and lugs throughout a broad range of feed speeds. Methods are included.

29 Claims, 6 Drawing Figures

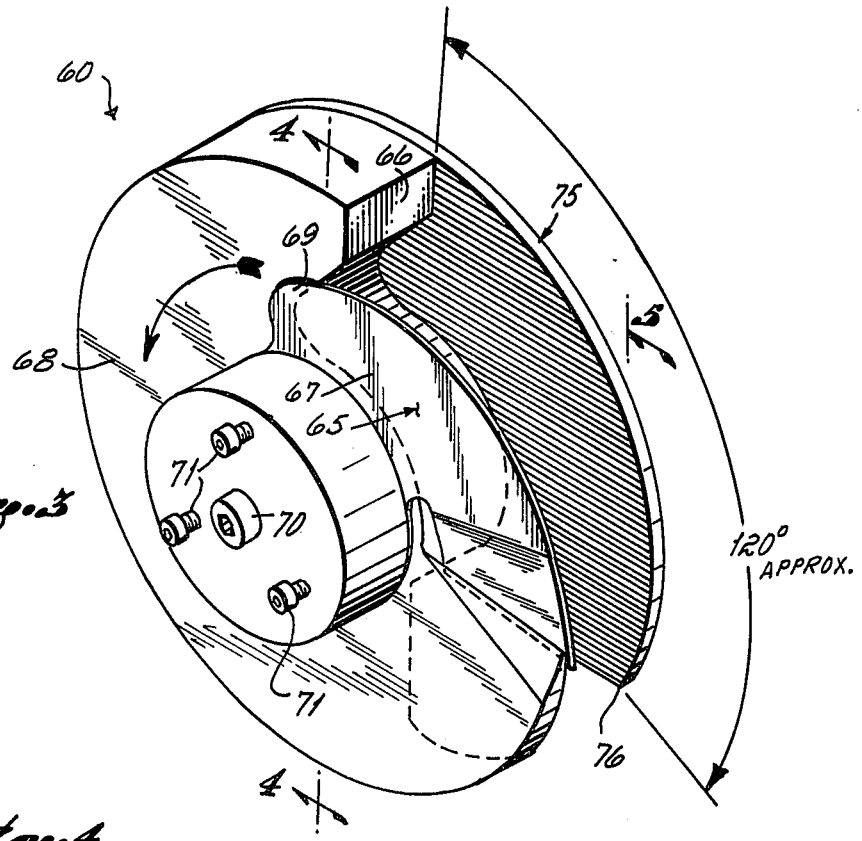
Fig. 3
Fig. 4
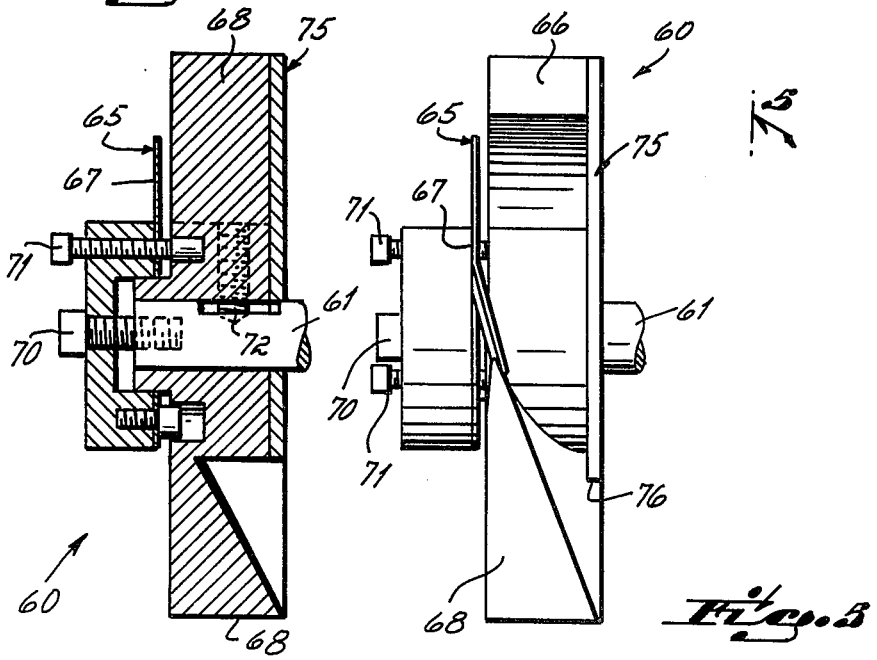
Fig. 5

HIGH SPEED CARTON FEEDER

This invention relates to apparatus for feeding cartons from a stack into a cartoner.

There have been many different mechanisms developed for feeding cartons from a stack into a cartoner. One such mechanism which is in widespread use provides a vertical magazine wherein flat folded cartons are stacked the cartons being in a horizontal attitude. Underneath the magazine are one or more suction cups which engage the lowermost carton to bow it slightly downwardly from the stack. The thus bowed carton is engaged by travelling lugs on a feed chain to thrust the carton out from under the bottom of the stack. In some instances reciprocating pusher blades are employed to drive the cartons out from under the stack.

There are a number of disadvantages to this type of carton feeder, these disadvantages also pertaining to many other variations of this type of carton feeder.

The carton feeder is slow, particularly for large cartons such as those containing breakfast cereals, crackers and the like. Because of the vertical stacking of the cartons in a horizontal attitude, the weight on the stack must be kept low so that the weight of the stack does not impede the sliding of the carton out from under the bottom of the stack. Reciprocating motions for the suction cups, for the pusher blades and for other associated equipment is required with the consequent expense of more complex linkages, cams and the like to effect the reciprocating motion.

It has been an objective of the present invention to provide a high speed feeder having many advantages relating to the ease of operation, reliability, positive control of cartons, longer life on the mechanism and the like as will appear below.

It has also been an objective of the invention to provide an air flow environment for controlling and handling cartons precisely.

This objective is attained by providing the following structure: a generally horizontal conveyor, preferably inclined downwardly toward the forward end at an angle of about 15°, and carrying an inclined stack of cartons resting on their edges in a generally vertical disposition. A helical metering wheel at the downstream end of the conveyor has an inclined blade which engages the upper ends of the cartons to separate the leading carton from the stack.

Horizontal feed chains having upwardly-projecting feed lugs extend from the conveyor to receive cartons as they swing from a vertical attitude to a horizontal attitude and to convey them away to the cartoner for erecting and filling.

The feeding mechanism is provided with means for positively swinging each carton downwardly from its vertical attitude to its horizontal attitude. In the embodiment which is preferred for larger cartons, an air blower is provided, the blower having three nozzles directed at the upper edges of the cartons. One nozzle, upstream of the metering wheel, blows downwardly and forwardly to push the cartons against the metering wheel. A second nozzle is oriented to blow between the first and second cartons to help separate the first carton from the second carton when it is released by the metering wheel. A third nozzle, downstream of the metering wheel, blows downwardly to drive the leading carton down against the feed chains. Preferably, the inlet side of the blower is connected to vacuum nozzles underlying the feed chains to assist in positively snapping the cartons down upon the feed chains, and for holding the cartons for positive engagement by the appropriate engaging lugs of the feed chains.

Instead of employing the preferred downwardly-directed nozzle to drive the cartons down, the invention also contemplates rotating arms or wheels which engage the released carton and positively swing it to a horizontal attitude. Nevertheless, use of the air flow environment for handling cartons during this movement is preferred.

In order to minimize the pressure of the upstream stack of cartons which leans forward toward the metering wheel, it is a feature of the invention to provide an adjustable pressure roller which engages the top edges of the cartons adjacent the metering wheel. Approximately thirty cartons are located between the pressure rollers and the metering wheel, with the pressure rollers holding back all of the hundreds of cartons which are upstream of the pressure roller.

Another feature of the invention is to provide a microswitch which senses the quantity of cartons between the pressure roller and the metering wheel. The switch is connected to the drive for the conveyor which supports the cartons. It has an "on" position which is operable to urge the cartons in a downstream direction as the supply is diminished. A time delay is preferably provided so that as the supply of cartons downstream of the pressure rollers becomes sufficiently great to move the switch to an "off" position, the conveyor will continue to advance for a short period of time to bring up approximately four additional cartons, thereby assuring that the switch lever is moved to a fully "off" position.

A problem arises in coordinating the movement of the carton from its vertical position to the horizontal position with the movement of the lugs on the feed chain which captures the carton in the horizontal attitude. When the carton leaves the downstream or release edge of the blade on the metering wheel, it is for a brief period not under the control of mechanical elements which are moving at the speed of the machine. That free period does not vary significantly with the speed of the machine. Since the feed chain and the metering wheel are timed together, a carton which swings to the horizontal attitude at 300 cartons per minute in satisfactory alignment with the feed lugs, may very well fall on top of the preceding feed lugs, out of alignment therewith, when the machine is operating at a significantly lower speed, as, for example, from 0 to 100 cartons per minute, as occurs when starting up the cartoner. To eliminate this problem, it is a feature of the invention to provide, downstream of the blade on the metering wheel, a release plate. The release plate has a release edge past which the carton may pass. The release edge is positioned about 120° away from the edge of the blade which separates the leading carton from the stack. When the feeding mechanism is operating slowly, the release plate holds the carton back until the lug is in proper timed relation to the carton and thereafter releases the carton so that it falls into proper position to be captured by the feed lugs.

The release plate is spaced downstream slightly of the inclined separating blade so that when released by the release plate, the carton is well free of the blade and is under control of the air which assists in the separation of the leading carton and which blows the carton down onto the lugs. This feature provides assurance that the carton will be relieved from the twisting action of the blade which has a tendency to cock the carton and prevent a straight fall into the feed lugs.

Moreover, positive carton control is assured by means of the vacuum nozzles to hold cartons in position until the next succeeding feed lugs come up to engage the rear end of the carton. Accordingly, should any carton fall partially onto a preceding lug, despite the timed release, the vacuum holds the carton and this lug simply slides out from beneath the carton without pulling it along in an improper position.

A still further feature of the invention is a carton check disposed downstream of the feeder conveyor for reducing the number of cartons available for actuating the conveyor control switch. Since the feed ramp is inclined, some cartons might slide down the ramp, holding the switch, and allowing more cartons than desired to be fed from the feeder before the conveyor is jogged to supply more cartons. This may permit more rearward cartons to fall forwardly at their tops, engaging the metering wheel at too great an angle. The check reduces the number of cartons available to actuate the switch, and insures more frequent conveyor jogging to maintain an adequate number of cartons on the feed ramps of the feeder downstream of the conveyor. This maintains the cartons in a more consistent position for sequentially engaging the metering wheel.

It is another feature of the invention to provide simplified mountings for the blower and metering wheel so that they can be shifted laterally and vertically in order to simplify the changeover of the apparatus to cartons of different sizes.

Finally, it has been an important objective of the invention to provide improved apparatus for feeding cartons from a stack onto a receiver, such as a bucket, lug, suction or other type conveyor, by a positive carton control system including a controlled air flow environment. It will be appreciated from the description herein that the cartons preferably are positively mechanically handled until released by the release plate of the metering wheel. From that approximate time until they engage the receiving conveyor, the cartons are positively controlled within a predetermined air or fluid flow environment which insures their precise position entry onto the receiving conveyor. Where it is desired to vary the feeding speed, the air flow environment is controlled to insure that cartons are positively placed onto the receiving conveyor and are held for reception thereof by the appropriate receiving apparatus such as a carton pushing lug.

The invention thus contemplates positive carton control throughout a carton feeding process which includes a controlled fluid flow environment for precisely and positively handling cartons from a mechanical release point to a predetermined mechanical engagement point.

The several objectives and features of the present invention will become more readily apparent from the following detailed description taken in conjunction with the accompanying drawings in which:

FIG. 3 is a perspective view of a metering wheel in accordance with the present invention;

FIG. 4 is a cross-sectional view taken on line 4—4 of FIG. 3; and

FIG. 5 is an end view of the metering wheel taken as can be seen when viewed along line 5—5 of FIG. 3.

Figure 1:
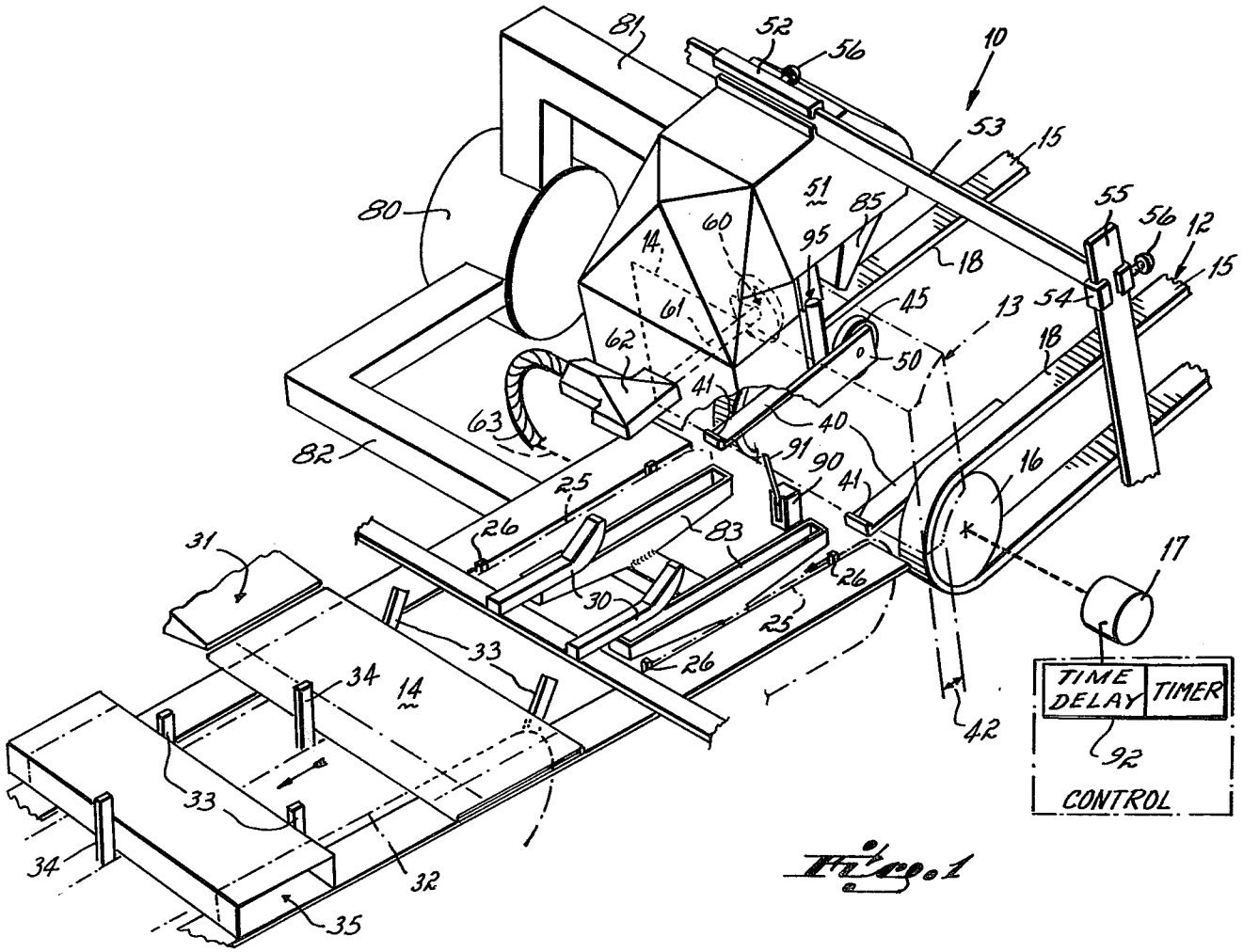
FIG. 1 is a fragmentary perspective view of the cartoner employing the present invention.
Figure 2:
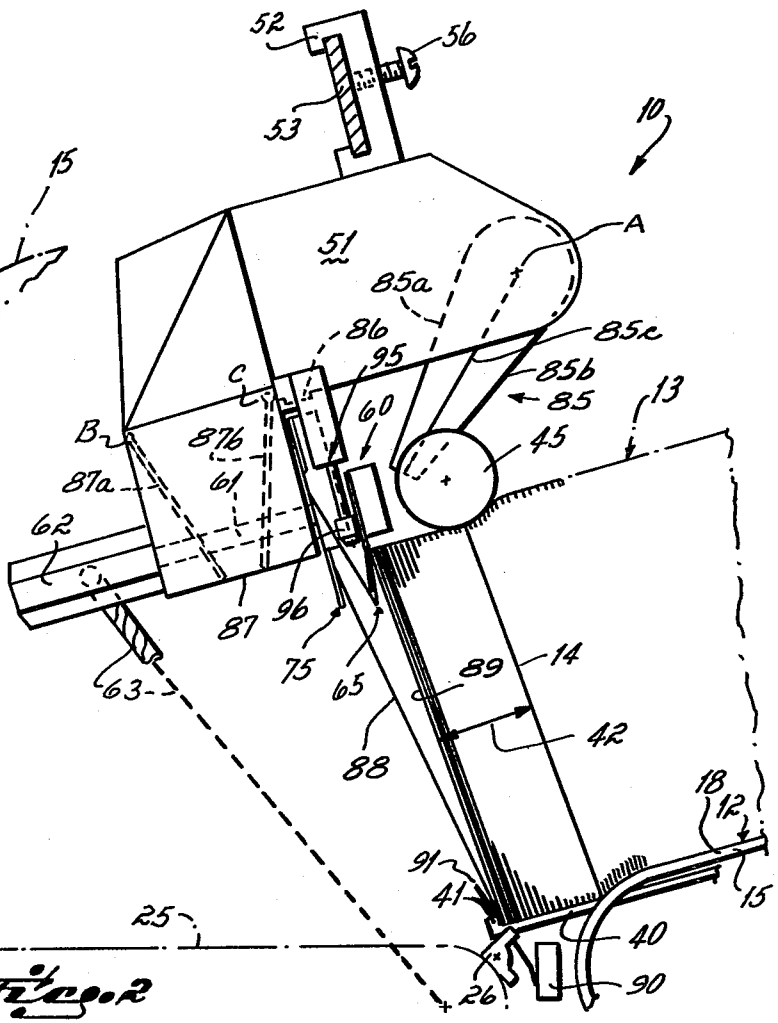
FIG. 2 is a side elevational view thereof.

The upstream portion of a cartoner is illustrated in FIGS. 1 and 2. The function of the cartoner generally is to receive a stack of cartons at one section of the machine, feed those cartons one at a time from the stack, open the cartons, fill the cartons with product and close the cartons. While the invention is described with particular reference to a cartoner, it should be appreciated that the invention is useful for delivering cartons, sheets, panels, and the like, to receiving apparatus such as conveyors, lugs, buckets, pockets, containers, and the like.

The present invention is addressed primarily to the mechanism for feeding the cartons to the cartoner. That mechanism indicated at 10 includes a conveyor 12 for a stack 13 of cartons 14. The conveyor 12 is formed of a pair of endless chains 15 passing around sprockets or pulleys 16 and driven by a motor 17. The conveyor has an upper run 18 which is preferably at an angle of about 15° to horizontal, being inclined downwardly toward the downstream end of the feeding mechanism. The angle should be just sufficient to cause the stack 13 to lean forward while remaining substantially vertical, thereby minimizing the pressure of the stack on the leading carton to be fed from the stack. While many other angles could be used, an angle in the range of about 15° to 30° from the horizontal is believed preferable, with an angle of about 15° being preferably described herein. A stack of cartons, then, such as stack 13, is an inclined or generally horizontal stack, as opposed to a vertical stack, wherein flattened cartons are each horizontally disposed, one atop another. In inclined stack 13, the cartons are generally vertically disposed, resting on their lower edges on conveyor 12.

The conveyor 12 may be quite long so that a large number of cartons may be stacked upon it at any one time. As will appear from the description below, it is a feature of the invention to permit the placement of a large number of cartons in the stack without causing undue pressure on the leading cartons because of a special pressure resisting mechanism to be described.

A pair of feed chains 25 extend downstream from the downstream ends of the conveyor chains 15. The feed chains have feed lugs 26 projecting upwardly from the upper run of the feed chains. The feed lugs 26 capture cartons in a horizontal attitude and advance them forward into the cartoning mechanism.

Overlying the feed chains are a pair of upper guide rails 30 which hold the carton in a flat condition while the feed chains advance the carton into a blow opening mechanism indicated at 31. The blow opener is of the type disclosed in U.S. Pat. No. 3,728,945.

Immediately adjacent the blow opener are parallel transport chains 32 having trailing transport lugs 33 and leading transport lugs 34. At the blow opener, the carton is erected to the condition indicated at 35 and is immediately captured between the leading and trailing transport lugs and advanced into the loading mechanism of the cartoner.

At the downstream end of the conveyor 12, there are a pair of ramps 40 terminating in upwardly-projecting stops 41, the ramps presenting upwardly-facing surfaces which receive a portion of the cartons in the stack, for example about 30 cartons, as those cartons pass over the downstream end of the conveyor 12. That group of a few cartons indicated at 42 has shifted downwardly from the main stack of cartons. At the intersection of the main stack of cartons and the downwardly-shifted few cartons 42, an adjustable pressure roller 45 is mounted, the pressure roller bearing on the upper edges of the cartons and holding back the upper edges of the stack upstream of the few cartons 42 located on the ramp 40.

Figure 2A:
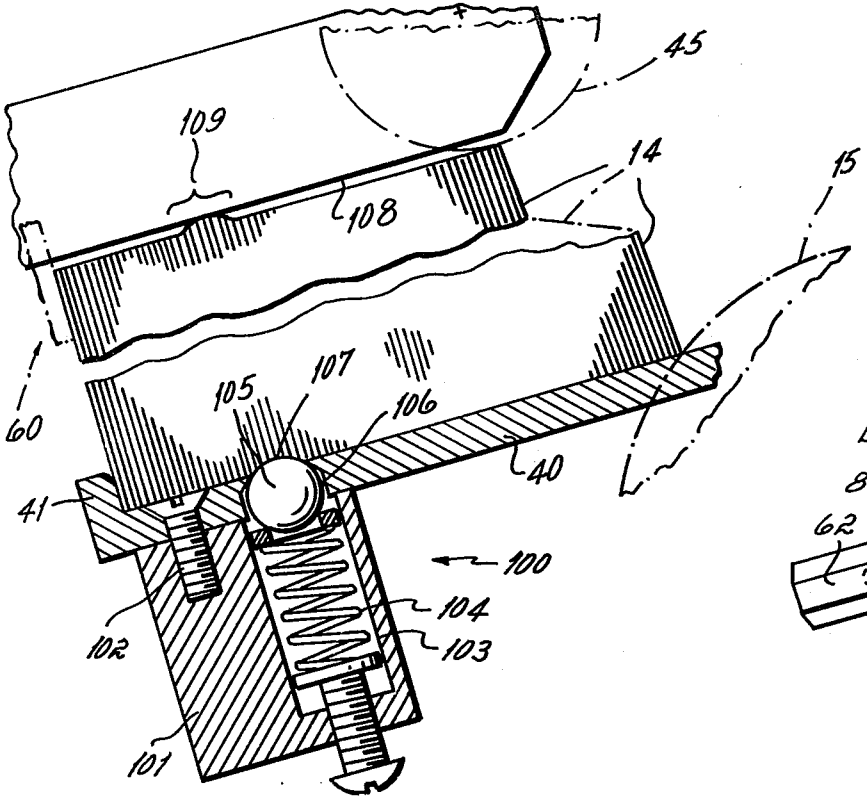
FIG. 2A is a more detailed side elevational view of the lower portion of FIG. 2, showing features of the invention deleted from FIGS. 1 and 2 for clarity.

Further detail of the ramps 40 is best seen in FIG. 2A. Each ramp includes a spring biased carton check 100, the function of which will be hereinafter explained. Check 100 includes a block 101 depending from each ramp and attached thereto by any suitable means such as countersunk screw 102. Block 101 is drilled to provide bore 103 in which is disposed a screw adjustable spring 104 supporting a ball check 105. Ball 105 extends through aperture 106 in ramp 40 such that a peripheral ball surface 107 extends a slight distance above the ramp's surface. Aperture 105 is peened or otherwise constricted to contain ball 105 from excessive upward movement.

The lateral disposition of the check 100 is between stop 41 and the pressure roller 45. As shown in FIG. 2A, cartons moving over ball surface 107 are raised to frictional contact at their tops with lower edge 108 of arms 50, at area 109. This check maintains both tops and bottoms of cartons rearwardly until such time as the magazine conveyor is operated to preload cartons past the check 100 against stop 41.

While check 100 is not consistently necessary for all types and sizes of cartons, it does promote positive operational control as will be described.

The pressure roller 45 is mounted between arms 50 which are in turn bolted to an air housing 51. The housing is fixed to a slide 52 which is mounted on a rail 53. The rail has at each end a slide 54 which is slidably mounted on a post 55. The slides 52 and 54 have set screws 56 by which the position of each slide is fixed with respect to the rail or post on which it is mounted. It can be observed that the housing 51 and all equipment associated with it can be adjusted laterally and vertically simply by the manipulation of the slides 52 and 54. Thus, the feeding assembly is easily adjusted to accommodate cartons of varying sizes.

A metering wheel 60 is rotatably mounted in the housing by means of a shaft 61. The shaft 61 is connected to a small gear box 62 and then to a flexible cable or shaft 63. The flexible cable or shaft is connected to and timed to the feed chains and lugs 25 and 26 so that for every revolution of the metering wheel, one feed lug 26 passes a point at which it can capture and advance a horizontal carton.

The metering wheel is best illustrated in FIGS. 3–5. It is generally cylindrical and is helically configured to separate individual cartons from stack 13. Specifically, the wheel has a blade 65 which is positioned with respect to the upper edges of the carton so that it will, upon rotation of the metering wheel, pass between the upper edges of leading or first and the next upstream or second carton to separate the two. The blade 65 has a trailing edge 66 which, when it passes the upper edge of a carton 13, will free that carton to permit it to move forward. The blade 65 is in two sections 67 and 68 which are axially adjustable with respect to each other so as to vary the opening between the leading edge 69 of the blade and the trailing edge 66, thereby accommodating the metering wheel to varying thicknesses of cartons. The section 67 is mounted on a boss which carries a central bolt 70 and three jack screws 71 and the section 68 is secured to shaft 61 by a pointed set screw 72. The axial position of the section 67 with respect to the trailing edge 66 is adjusted by releasing set screw 72 and rotation of the jack screws 71. When the desired position is attained, it is fixed in that position by tightening down on the set screw 72.

At the downstream side of the metering wheel, a release plate 75 is mounted and presents a trailing edge 76 which is spaced approximately 120° from the trailing edge 66 of the blade 65. The release plate is formed as a part of a circle whose upstream surface will block the forward movement of a carton released from the blade until the trailing edge 76 has passed the upper edge of the carton. After the trailing edge 76 has passed the upper edge of the carton, the carton is then free to fall forward to a horizontal position to be captured by the feed lugs of the feed chain 25.

The blower housing 51 is connected to an air blower 80 by means of a blower hose 81. The inlet side of the blower 80 is connected by a suction hose 82 to a pair of vacuum nozzles 83. The nozzles 83 are positioned alongside the feed chains 25 and will act upon a carton blank which has been swung to the horizontal position and hold it firmly against the suction nozzles until a feed lug 26 engages the trailing edge of the carton. If the carton's forward edge portion should inadvertently land upon a downstream feed lug, the vacuum should hold the carton against the conveyor rails or suction nozzles until the proper feed lug engages the trailing edge of the carton, thereby permitting the downstream lug to slide out from under the carton.

In the illustrated form of the invention, the blower housing has three nozzles 85, 86 and 87 (best shown in FIG. 2). It can be seen that the nozzle 85 directs air downwardly and forwardly against the upper edges of the cartons at a location just upstream of the metering wheel 60. The function of that air jet is to drive the upper edges of the carton against the metering wheel to be sure that the leading carton is captured by the leading edge 69 of the metering wheel as the metering wheel rotates.

Nozzle 85 is rotatable about axis A and is made from two halves, **85*a* and 85*b*, having overlapping sides meeting, for example, at the line 85*c***. These halves may be moved toward or away from each other to vary the nozzle opening and the velocity of the air flowing therefrom.

The nozzle 86 is oriented to blow straight down into the space between the leading carton or first carton indicated at 88, and the following adjacent or second carton 89, held behind the metering wheel. That flow of air assures good separation between the cartons 88 and 89 and encourages the carton 88 to swing forwardly when released by the release plate 75.

The third nozzle 87 directs air substantially straight down toward the feed chains 25 so as to intercept a forward falling carton 88 and blow it positively down against the feed chains and the vacuum nozzles 83.

This nozzle includes pivoted forward and rearward baffle plates **87*a* and 87*b*, each of which can be pivoted about their respective axes B and C to vary the velocity and direction of air issuing from nozzle 87**.

It should be understood that it would be within the scope of the present invention to replace the blower system, or parts of it, with a mechanism for capturing a released carton and positioning it on the feed chain. The preferred embodiment, however, contemplates the positive control of the released carton by means of a predetermined air flow environment.

A microswitch 90 connected to conveyor drive 17 is mounted adjacent the stops 41 on the ramps 40. The microswitch carries an upwardly projecting arm 91 which is in the path of the lower edges of the leading cartons in the stack. The arm 91 is adapted to swing rearwardly until it reaches a point at which it causes the operation of the drive 17 which advances the conveyor 12 to bring a fresh supply of cartons onto the ramps 40. For purposes of this description, drive 17 includes a motor for driving the conveyor through an electrically actuated clutch-brake apparatus of any suitable type.

When the forward movement of the downstream few cartons 42 has been sufficient to swing the arm 91 forwardly to its original position, the switch 90 will be operated to effect the de-energization of the clutch-brake of drive 17. A time delay 92 is preferably interposed in the circuit to permit the conveyor 12 to over-travel slightly after the microswitch has been swung to an "off" position. This over-travel, as permitted by the time delay, minimizes the need for a very precise positioning of the microswitch and associated arm 91.

Also included in the control circuit is a timer which monitors running of the drive 17 and de-clutches the drive after a predetermined time period, even if the switch 90 has not been moved. This indicates either malfunction of switch 90 or misfeed of stack 13 and helps prevent serious jamming.

In the operation of the invention, an inclined stack of cartons is placed on the conveyor 12. That stack of cartons may project rearwardly many feet. It will be appreciated that the operator will have no difficulty in placing those cartons in the magazine in view of the fact that by stacking the cartons on an incline, and generally horizontally, the position of the stack for new cartons is always readily accessible, and it is not necessary to utilize a stack follower, for example. The cartoner is started. The blower 80 draws air from the suction nozzles 83 and blows air through the three nozzles 85, 86 and 87. The metering wheel 60 rotates. With each revolution, the leading edge 69 of the blade 65 slides between the first and second cartons 88 and 89 to advance the upper edge of the leading carton 88 forwardly. The flow of air from the nozzle 85 provides assurance that the leading carton 88 will be initially forced against the metering wheel so that the leading edge of the blade can slide between the first and second cartons. Also, some portion of this flow, such as 40%, for example, is directed over the tops of the most forward cartons, assisting in urging released cartons in a predetermined direction.

Continued rotation of the metering wheel causes the trailing edge of the blade to pass the upper edge of the carton 88 permitting it to fall forward against the release plate 75. The carton is held there through rotation of approximately 120° whereupon it is released by the trailing edge 76 of the release plate. During this time, air from the nozzle 86 is blown between the first and second cartons 88 and 89 to separate them and to cause the carton 88 to swing forwardly. When the carton 88 is released, it is picked up by the flow of air from the nozzle 87 (and preferably a portion of the air flow from nozzle 85) and driven downwardly onto the vacuum nozzles 83. When in the generally horizontal attitude on the nozzles 83, a feed lug 26 engages the rearward end of the carton and advances it forwardly. Thereafter, the carton is blown open by the opener 31 and captured by the transport lugs 33 and 34 of the transport conveyor 32.

When the machine is operating at high speed as, for example 250–300 cartons per minute, the release plate is not a significant factor in assuring that the carton falls between a pair of feed lugs 26. However, at very low speeds when starting the cartoner, if there were no release plate, then the falling carton would likely fall upon a downstream feed lug and perhaps be hung up there. It should be understood that for a given constant flow environment, the carton requires a fixed time to swing from its generally vertical orientation to a horizontal orientation. When the feed chain is travelling very slowly as, for example 50 cartons per minute or less, the feed lug 26 does not have sufficient speed to get out of the way of the falling carton. Therefore, the release plate is required to hold the carton back to provide sufficient time for the downstream feed lug to advance to a position where the carton can fall into a space between advancing feed lugs.

The lug center-to-center distance is normally greater than the carton width (distance between upstream and downstream edges of a carton) so as to be tolerant of variations in the time that the carton is required to fall to the horizontal position. The release plate permits closer, more desirable center-to-center carton spacing, by promoting more exacting carton control, thus maximizing the number of carton positions on conveyor 25, for example.

Also, it should be appreciated that even if a carton falls from the release plate and engages a preceding lug, vacuum nozzles 83 capture and hold the carton in position until the proper succeeding lugs engage the rear end of the carton. The preceding lug then, is not permitted to drag the carton along, but merely slides under it, the carton being securely held by the vacuum means portion of the controlled air flow environment.

In operation, then, and according to the invention, it is easier to time the feeder apparatus with the receiver conveyor for normal fast speed running, at the rate of about 250–300 cartons per minute, and control carton delivery at lower speeds by means of the release plate and the carton hold vacuum. When the feeder is delivering at its fast speed, cartons are precisely synchronized with the receiving conveyor. When the receiving conveyor is run slowly, the release plate is timed to delay carton release and if cartons do fall on preceding lugs, the cartons are held by the vacuum and the preceding lugs simply slide under the cartons.

Accordingly, it is not necessary to vary the air flow characteristics of the air flow environment, so as to alter carton delivery speeds in that environment, even though carton output speeds are varied from 250–300 cartons per minute, down to 50 cartons per minute, for example. Of course, the invention could be timed and adjusted to precisely drop cartons at the 50 carton per minute speed; however, re-adjusting for the faster speeds would require extra time, equipment and control manipulations. Timing for fast speeds and automatically accommodating slow speeds via a built-in function of the air flow environment is more preferable.

The air housing 51 preferably carries a pneumatic stop 95 which is located adjacent the upper edge of the leading carton 88. It carries a downwardly projectable lug 96. When it is observed, as by an electric eye, that a product bucket has failed to receive product, the stop is actuated to block the discharge of one carton corresponding to the position of the empty product bucket as is conventional in cartoners of this type.

Should there be a need to adjust the feeding mechanism to accommodate cartons of a different size, the complete unit of blower, metering wheel, stop element 95 and pressure roller can be shifted vertically as well as laterally by manipulation of the slides 52 and 54. Additional adjustments, of course, must be made to the rest of the cartoner, but it can be seen that with the feeding mechanism of the present invention, with the major elements mounted on the air housing 51 attached to the slides 52, 54 the adjustment over prior art feeders is greatly simplified.

Finally, the check 100, shown in detail in FIG. 2A, serves to promote positive control over the cartons between conveyor 18 and stop 41. In particular, numerous cartons 42 are located in this area. Due to the incline and the agitation of the cartons by the blower air, some of these cartons, and particularly the forward ones, may tend to slide down the ramp and engage the switch 90. This "fools" the apparatus by delaying actuation of the conveyor feed for more cartons. Accordingly, the area between stop 41 and conveyor 18 is more depleted of cartons than is desired. In other words, more cartons are fed from this area than desired before the conveyor is actuated.

As a result of too few cartons in this area, more rearward cartons which have not moved down the ramp will fall forward, their upper ends engaging the metering wheel at too great an angle, or actually falling under the metering wheel. This problem is particularly pronounced with thin cartons or those with certain coatings.

The check 100 serves to eliminate this difficulty by checking cartons behind the ball 105 such that only a few cartons, such as eight or so, are located between the ball and stop 41. When these are depleted, there are no more cartons to hold switch 90 and it operates to actuate the conveyor. When the conveyor is actuated, cartons are fed pressing the remaining ramp supported cartons past the ball check and pressure roller support arm toward stop 41.

In operation, then, only cartons forward of the ball 105 and the area 109 of the pressure roller mounting arm edge 108 can be fed from the feeder until the conveyor is jogged. The ball check effectively limits the number of cartons available to actuate switch 90, and eliminates any need to precisely adjust the spring bias of the switch 90 in correlation with carton force. More positive control of the cartons, throughout the feeding process, is thus provided.

It should be appreciated that the preferred embodiment of the invention mechanically handles cartons precisely until that point when they are released by the release plate 75. From that time, until the cartons engage the receiver means, such as the conveyor 25, the cartons are not directly under the influence of mechanical control. Nevertheless, the air flow environment, created principally by nozzles 85 and 87 and vacuum nozzles 83, constitutes a positive carton control zone wherein cartons are precisely handled to the same repeatable tolerances.

This flow environment is predetermined by the opening size of nozzles and by the direction of flow issuing therefrom. Closing the nozzles increases the flow and thus the positive force exerted on the cartons, while variations in flow direction vary the component of forces exerted in particular directions.

Thus, for example, plates 87*a* and 87*b* can be rotated clockwise about axes B and C (FIG. 2) to cause the flow issuing therefrom to engage the falling cartons at a higher position, causing the cartons to jump more forwardly than for more rearward positions of the nozzle 87. Likewise, moving the plates 87*a* and 87*b* together for any flow direction, constricts the nozzle and increases the flow force on the carton, accelerating it. These adjustments, together with the initial effect of the overflow from nozzle 85 and the effect from vacuum nozzles 83, determine the speed and direction of the carton movement.

The invention then, also contemplates the combination of precise mechanical handling of cartons to a release point, and thereafter the precise air flow handling of cartons from a release point to a carton destination point on a receiving conveyor, for example. The metering wheel produces a very precise carton release point which, viewed in another way, is a precise air flow environment entry point. Since the cartons are precisely released into a constant controlled flow environment, they can be repeatedly accurately handled in the constant flow environment for precise delivery onto a receiving conveyor, the air flow environment further providing carton holding means for accommodating large variations in carton output speeds.

Finally, while the metering wheel herein is described as preferably utilized at the carton tops, it should be recognized that the wheel could be used at the cartons' sides, or at the cartons' bottoms, with an appropriate air flow environment constructed to produce a desired carton movement and disposition from the stack.

Having described our invention, we claim:

1. Apparatus for feeding flat folded cartons into a cartoner comprising, a generally horizontal conveyor for receiving a stack of cartons on their edges in a generally vertical orientation, a metering wheel at the downstream end of and above said conveyor, means for rotating said metering wheel, means for driving the conveyor to advance said cartons toward said metering wheel, a blade on the surface of said metering wheel to slide between the upper edges of first and second leading cartons to thrust the edge of said carton forward from said stack, a horizontal feed mechanism forward of said conveyor and having spaced feed lugs for receiving cartons one at a time and advancing them into said cartoner, and an air blower overlying said cartons to blow cartons, which have been thrust forward from said stack by said blade, from a generally vertical orientation to a horizontal orientation down upon said feed mechanism.

2. Apparatus as in claim 1 in which said air blower has a first nozzle rearward of said metering wheel which is directed downwardly and forwardly against cartons upstream of said metering wheel to thrust cartons against said metering wheel, and a second nozzle forward of said metering wheel which is downwardly directed to blow cartons down upon said feed mechanism.

3. Apparatus as in claims 1 or 2 further comprising vacuum creating means underlying said feed mechanism to draw cartons down upon said feed chains, and to hold them for pickup by appropriate feed lugs.

4. Apparatus as in claims 1 or 2 in which said air blower includes an inlet under said feed mechanism creating a vacuum under said feed chains and having at least one nozzle adjacent said metering wheel.

5. Apparatus as in claim 2 further including a third nozzle directed downwardly at said metering wheel for separating a carton operated by said wheel from a following carton.

6. Apparatus as in claim 2 in which said blower and metering wheel are joined together as a single unit, means mounting said single unit for lateral and vertical adjustment with respect to said conveyor.

7. Apparatus as in claim 2 wherein the first and second nozzles are adjustable to vary the direction and velocity of flow issuing therefrom.

8. Apparatus for feeding flat folded cartons into a cartoner comprising, a generally horizontal conveyor for receiving a stack of cartons on their edges in a generally vertical orientation, a metering wheel at the downstream end of said conveyor, means for rotating said metering wheel, means for driving the conveyor to advance said cartons toward said metering wheel, a blade on the surface of said metering wheel to slide between the edges of first and second leading cartons to thrust the edge of said carton forward from said stack, a feed mechanism forward of said conveyor for receiving cartons one at a time and advancing them into said cartoner, said means for rotating said metering wheel including a flexible shaft connected to and timed to said feed mechanism, and means for mounting said metering wheel above said conveyor for lateral and vertical adjustment with respect to said conveyor.

9. Apparatus for feeding flat folded cartons into a cartoner comprising, a generally horizontal conveyor for receiving a stack of cartons on their edges in a generally vertical orientation, a metering wheel at the downstream end of and above said conveyor, means for rotating said metering wheel from zero rpm to at least about 250 rpm, means for driving the conveyor to advance said cartons toward said metering wheel, a blade on the surface of said metering wheel said blade having a first section presenting a leading edge to slide between the upper edges of first and second leading cartons to thrust the edge of said carton forward from said stack to swing said cartons to a horizontal attitude, said blade having a second section spaced slightly downstream of said first section and presenting a surface to hold back the upstream cartons, said blade having a trailing edge spaced downstream from said leading edge for partially releasing said cartons, a horizontal feed chain forward of said conveyor and having spaced feed lugs for receiving cartons one at a time and advancing them into said cartoner, and a release plate downstream from said blade and formed as a part of a circle to capture cartons from said blade at low speeds and to release cartons in timed relation to said feed lugs on said chain.

10. Apparatus as in claim 9, further comprising, means for adjusting the space between said leading edge of said blade and said adjacent downstream surface on said second section to accommodate cartons of varying thickness.

11. Apparatus as in claim 9, further including means for blowing cartons released from said release plate onto said feed chain, and vacuum means for holding cartons against movement until engagement thereof by predetermined feed lugs on said chain.

12. Apparatus for feeding flat folded cartons into a cartoner comprising, a generally horizontal conveyor for receiving a stack of cartons on their edges in a generally vertical orientation, mechanical means for separating leading cartons from said stack, and a blower means for delivering separated cartons through approximately 90° to a generally horizontal attitude to a receiving conveyor associated with said cartoner, said mechanical means including a carton release member disposed adjacent said blower means for releasing cartons from said stack to be acted upon by said blower means 13. Apparatus as in claim 12 wherein said mechanical means comprises:

a metering wheel at the downstream end of said conveyor, means for rotating said metering wheel, means for driving the conveyor to advance said cartons toward said metering wheel, and a blade on the surface of said metering wheel to slide between the edges of first and second leading cartons to thrust the edge of said carton forward from said stack.

14. Apparatus as in claim 13 wherein said metering wheel further comprises a release plate disposed forwardly of said blade and formed as part of a circle to capture cartons from said blade and to release cartons from said wheel at a predetermined angular disposition of said wheel.

15. Apparatus as in claim 12 wherein said blower means comprises a first nozzle rearward of said mechanical means and which is directed downwardly and forwardly against cartons upstream of said mechanical means to thrust cartons against said means, and a second nozzle forward of said mechanical means and which is downwardly directed to blow cartons down upon said receiving conveyor.

16. Apparatus as in claim 15 wherein said blower means further comprises a third nozzle directed downwardly at said mechanical means for separating a carton operated on by said means from a following carton.

17. Apparatus as in claim 15 further comprising a vacuum creating means underlying said receiving conveyor for drawing cartons onto said receiving conveyor and for holding cartons against undesirable lateral movement.

18. Apparatus for feeding flat articles from a generally horizontal stack of articles, onto a receiver means, said apparatus comprising, mechanical means for separating articles from said stack and for releasing articles so separated, and a blower means for pivoting articles through about 90° to said receiver means from said mechanical means, said blower means comprising a first nozzle for primarily blowing articles initially from said mechanical means and a second nozzle for blowing released articles onto said receiver means, and said articles moving from a generally vertical, toward a generally horizontal disposition.

19. Apparatus as in claim 18 further comprising a vacuum creating means for drawing articles toward said receiving means.

20. Apparatus as in claim 19, including means supporting lower edges of said articles when said mechanical means is operated to separate a leading article carton from said stack, said released articles pivoting generally about said lower edges.

21. A method for feeding cartons from a generally horizontal stack onto a receiving conveyor, wherein generally vertically disposed cartons in said stack are laid onto said receiving conveyor in a generally horizontal disposition, said method including the steps of:

advancing cartons to a discharge end of said stack, engaging endmost cartons of said stack with mechanical carton separating and release means, blowing air onto said endmost cartons to urge them against said mechanical means, releasing said cartons from said mechanical means, and blowing said cartons through about 90° onto said conveyor.

22. A method as in claim 21 wherein the step of blowing said cartons onto said conveyor includes blowing air against the tops of said cartons and rotating said cartons about lower edges thereof.

23. A method as in claim 22 including the further step of blowing air downwardly onto said cartons operated on by said mechanical means to separate an endmost carton from a next succeeding carton.

24. A method as in claim 21 including the step of mechanically separating an endmost carton from said stack and thereafter retaining said separated carton for a predetermined dwell time prior to said releasing step.

25. A method as in claim 21 wherein said advancing step includes the step of relieving a portion of said advancing force from endmost cartons in said stack.

26. A method of feeding cartons from a generally horizontal stack onto a receiving conveyor including the steps of, advancing cartons in said stack to a discharge end of said stack disposed in an air flow zone, engaging endmost cartons at said discharge end with mechanical carton separating and release means, separating an endmost carton from said stack and mechanically releasing such carton into said air flow zone, rotating said released carton through about 90° by means of air flow in said zone, and conveying said carton onto said receiving conveyor by means of air flow in said zone.

27. A method of transferring flattened cartons from an inclined stack into a cartoner wherein flattened cartons are opened, filled with product, and closed, said cartoner including a carton receiving conveyor for receiving cartons from said stack and moving cartons through said cartoner by means of conveyor lugs, said inclined stack including a plurality of cartons in generally vertical dispositions resting on lower edges thereof, and said method including the steps of:

advancing cartons in said stack to a discharge end thereof, said discharge end being located in an air flow zone, pressing an endmost carton against a stop at the carton bottom, engaging said endmost carton proximate upper edges thereof with carton separating and release means, blowing said endmost carton against said separating and release means, separating said endmost carton from said stack by means of a helical metering wheel, blowing air between said endmost carton and said stack to separate said endmost carton therefrom, releasing the top of said endmost carton and blowing air thereagainst to rotate said carton through about 90° about a bottom edge thereof, and to convey said carton onto said receiving conveyor.

28. A method as in claim 27 including the step of holding said carton top, after said separating step, for a predetermined dwell time, and thereafter releasing said carton top in timed coordination with respective lugs on said receiving conveyor.

29. A method as in claim 28 including the step of driving said metering wheel by means of a drive connection from said receiving conveyor.

* * * * *

UNITED STATES PATENT AND TRADEMARK OFFICE

CERTIFICATE OF CORRECTION

PATENT NO. : 4,429,864

DATED : February 7, 1984

INVENTOR(S) : Eric W. Scarpa; Charles C. Hughes; Stanley F. Humbert

It is certified that error appears in the above-identified patent and that said Letters Patent is hereby corrected as shown below:

Column 13, line 10, claim 20, delete "19" and insert -- 18 --

Signed and Sealed this

*Tenth* Day of *July 1984*

[SEAL]

*Attest:*

GERALD J. MOSSINGHOFF

*Attesting Officer*

*Commissioner of Patents and Trademarks*